US005744784A

United States Patent [19]

Schluckebier

[11] Patent Number: 5,744,784

[45] Date of Patent: Apr. 28, 1998

[54] LOW-LOSS INDUCTION COIL FOR HEATING AND/OR MELTING METALLIC MATERIALS

[75] Inventor: Dieter Schluckebier, Simmerath, Germany

[73] Assignee: Otto Junker GmbH, Germany

[21] Appl. No.: 750,589

[22] PCT Filed: May 11, 1995

[86] PCT No.: PCT/DE95/00622

§ 371 Date: Feb. 27, 1997

§ 102(e) Date: Feb. 27, 1997

[87] PCT Pub. No.: WO95/35014

PCT Pub. Date: Dec. 21, 1995

[30] Foreign Application Priority Data

Jun. 13, 1994 [DE] Germany ..... 44 20 463.9

[51] Int. Cl.[6] ..... H05B 6/42

[52] U.S. Cl. ..... 219/674; 219/677; 336/57; 336/62; 373/154

[58] Field of Search ..... 219/674, 677, 219/672; 336/57, 58, 62, 223, 154; 373/158

[56] References Cited

U.S. PATENT DOCUMENTS

| | | | |
|---|---|---|---|
| 1,839,801 | 1/1932 | Northrup | 219/674 |
| 2,457,843 | 1/1949 | Strickland, Jr. | 219/674 |
| 3,260,792 | 7/1966 | Kreisel | 219/674 |
| 3,809,846 | 5/1974 | Baumgartner et al. | 219/677 |
| 5,391,863 | 2/1995 | Schmidt | 219/677 |
| 5,430,274 | 7/1995 | Couffet et al. | 219/677 |
| 5,461,215 | 10/1995 | Haldeman | 219/677 |

FOREIGN PATENT DOCUMENTS

| | | |
|---|---|---|
| 0 438 366 | 7/1991 | European Pat. Off. . |
| 0 240 099 | 4/1994 | European Pat. Off. . |
| 523 823 | 4/1931 | Germany . |
| 10 95 903 | 12/1960 | Germany . |
| 11 79 655 | 10/1964 | Germany . |
| 2 052 836 | 1/1981 | United Kingdom . |

*Primary Examiner*—Philip H. Leung
*Attorney, Agent, or Firm*—Shook, Hardy & Bacon L.L.P.

[57] ABSTRACT

Described is a low-loss induction coil for heating and/or melting metallic materials, the coil having windings formed by lengths of hollow tubing carrying a fluid coolant. In the central zone of the induction coil, the current is carried by hollow conductors made of copper which at the same time form the hollow tubing. Fitted at least in the windings at one end of the coil is a current-carrying element in the form of at least one braid whose individual conductors are insulated from each other, while remaining windings are designed as hollow conductors connected to the current-carrying element. The use of braids as the current carrier leads, at the end of the coil, to a reduction in eddy-current losses caused by transverse magnetic fields, while the use of hollow conductors in the rest of the coil results in the mean distance between the current flux and the metallic material being heated being kept at the minimum and losses due to this distance thus kept low.

20 Claims, 2 Drawing Sheets

Figure 1:
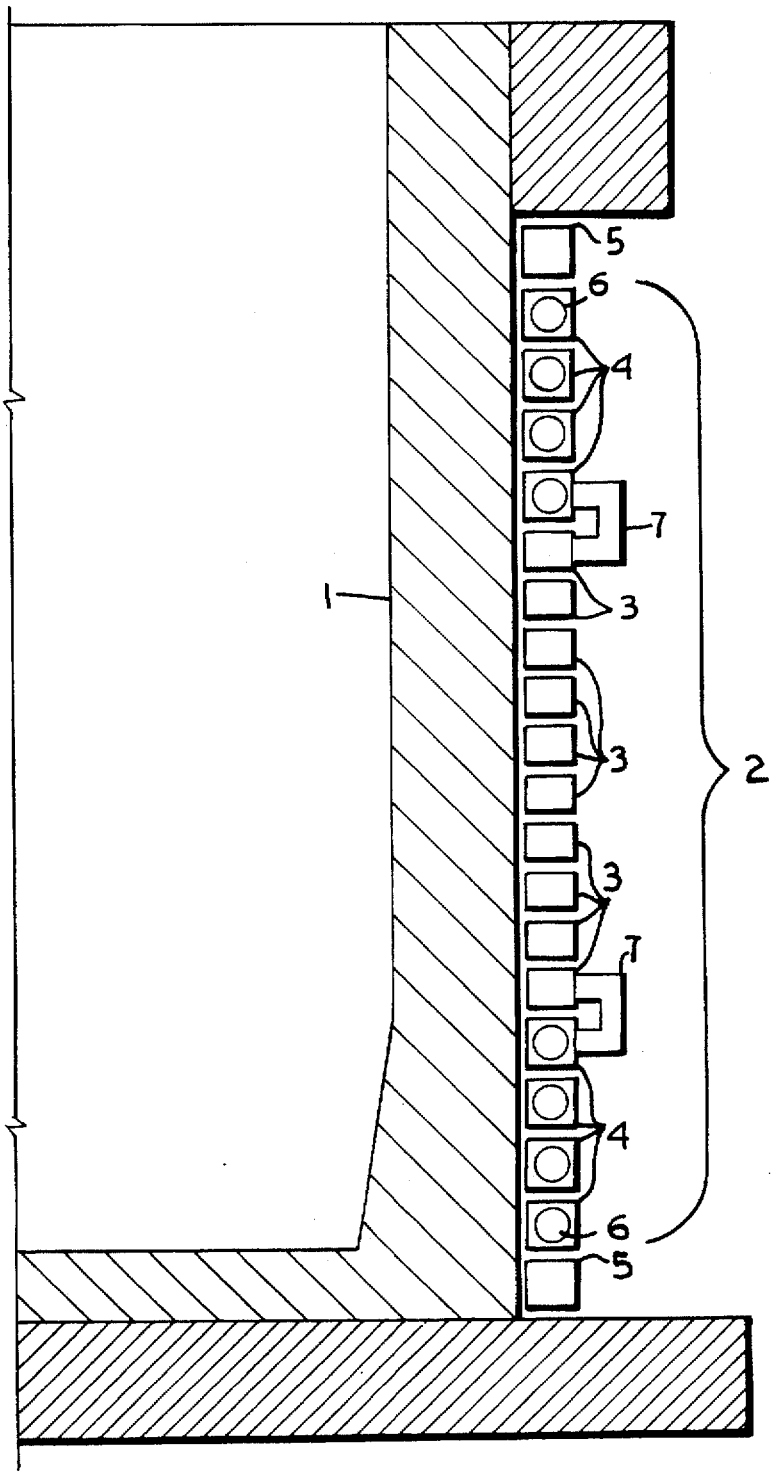

Fig. 2.
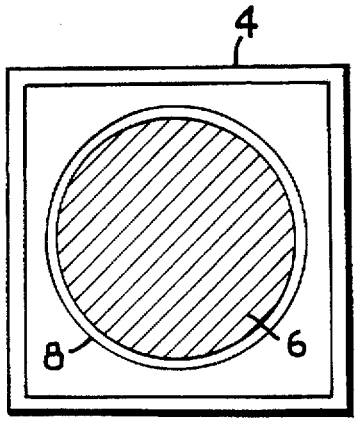
Fig. 3.
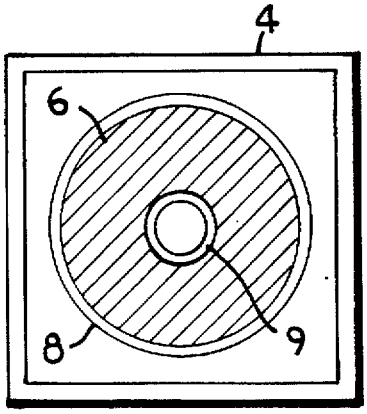
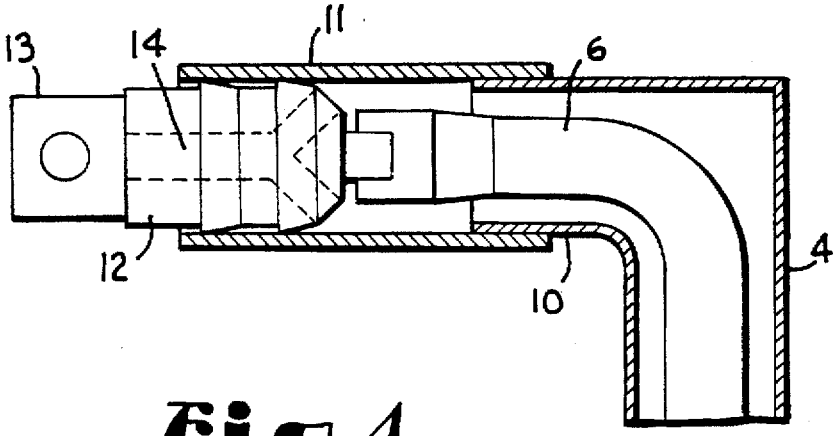
Fig. 4.

LOW-LOSS INDUCTION COIL FOR HEATING AND/OR MELTING METALLIC MATERIALS

DESCRIPTION

The invention relates to a low-loss induction coil for heating and/or melting metallic materials, the coil having windings formed by lengths of hollow tubing and carrying a coolant.

Induction coils of the abovementioned type and consisting of hollow conductors made of copper are known. The induction current is carried through these hollow conductors, while a fluid coolant, e.g. water, flows through the interior of the hollow conductors. Increased energy losses occur in the end zones of induction coils designed in this manner, since the transverse magnetic fields occurring to an increased extent there induce eddy currents in the hollow conductor made of copper.

It is known from EP 0,240,099 A2 to carry the induction current solely through a plurality of individual conductors which run parallel to one another, are insulated from one another, and are combined to form braids. In this case, the cross section of the individual conductors is dimensioned such that no significant eddy currents can occur in the end regions of such induction coils.

Compared to the induction coils made of hollow conductors, these induction coils have the disadvantage that their manufacture and also the measures required to guarantee sufficient cooling are more complex and more expensive. Despite the electrically insulating means surrounding them, e.g. lacquer or insulation tubing, the individual conductors or braids must have a good thermal contact with the coolant.

A further disadvantage of the current transport through braids, i.e. through a large number of individual conductors, results from the spatial distribution of the current density thus caused. Since each individual conductor carries current, the current density is distributed approximately uniformly over the cross section of the braid, and the mean distance between the induction current and the metallic material being heated is thus determined approximately by the braid center. In contrast, in the case of hollow conductors, the current density is concentrated on the part of the cross section of the hollow conductor facing the inside surface of the induction coil. With the same inside radius of the coil, the mean distance between the induction current and the metallic material being heated is thus higher in one braid coil, as a result of which here the losses caused by this distance are greater at the same time.

The object of the present invention is to provide an induction coil of the type mentioned at the beginning, which reduces the losses over the entire coil length in an efficient and cost-effective manner.

In an induction coil of the type mentioned at the beginning, this object is achieved according to the invention in that a current-carrying element in the form of at least one braid consisting of insulated individual conductors is provided in the windings in at least one of the end zones of the induction coil, and that the remaining windings are designed as hollow conductors and are each electrically connected to the current-carrying element.

In such a coil, the advantages of the coil constructions combined with one another here come into effect.

In the end zones, the current is carried through braids, as a result of which losses due to transverse magnetic fields are avoided to a great extent. Moreover, it has been shown empirically that, when braid conductors are used, the active zone of the coil is longer than when hollow conductors are used. The reason for this is presumably a lower permeability of the braid windings to transverse magnetic fields, since here the current density is distributed uniformly over the cross section of the braid. In contrast, in the case of hollow conductors, the current density can concentrate on partial zones of the cross section, as a result of which other zones remain virtually currentless and thus provide gaps for transverse magnetic fields to pass through.

In the central zone of the coil where the induced magnetic field has no significance in the radial direction, the simple and cost-effective construction variant with the hollow conductors is used. Additionally, by using hollow conductors, the mean distance of the current density from the material being heated is minimized, thus also minimizing the losses caused by the distance.

The coil according to the invention can be of such a design that the lengths of hollow tubing receiving the braid(s) consist of a non-magnetic material of poor conductivity.

The induction coil according to the invention can also be constructed in such a way that the lengths of hollow tubing receiving the braid(s) consist of V2A special steel.

For the application in question here, V2A special steel has the advantage of low electrical conductivity in addition to its thermal and chemical resistance. As a result, the occurrence of eddy currents in the lengths of hollow tubing carrying the fluid coolant is avoided.

Moreover, the induction coil according to the invention can be constructed in such a way that the hollow conductors and the individual conductors of the braid(s) are made of copper.

The induction coil according to the invention can also be constructed in such a way that each braid is surrounded by an insulation which is resistant to high temperatures and to the coolant.

As a result, the individual conductors of the braid are held together and additionally are protected from mechanical loading and from a potentially harmful effect of the coolant.

The induction coil according to the invention can also be designed in such a way that a cooling channel carrying a coolant is provided inside a braid.

As a result, sufficient heat dissipation can be guaranteed, even at high current strengths.

Moreover, the induction coil according to the invention can be of such a design that a plurality of braids form a braid bundle which is surrounded by an insulation which is resistant to high temperatures and to the coolant.

The induction coil according to the invention can also be of such a design that a cooling channel carrying the coolant is provided inside a braid bundle.

Additionally, the induction coil according to the invention can be of such a design that the cross section of the lengths of hollow tubing is rectangular.

Finally, the induction coil according to the invention can be of such a design that a current terminal which is electrically connected to the braid(s) is attached to the outside of the coil at the end, adjacent to the hollow conductor, of each length of hollow tubing receiving the braid(s).

The rectangular profile of the lengths of hollow tubing has the effect, compared to round profiles, of greater positional stability of the individual windings lying one on top of another. Moreover, with given dimensions of width and height of the hollow tubing with a rectangular profile, the volume of the space thus enclosed is at a maximum, thus also maximizing the throughput of coolant. Furthermore, disturbing gaps between hollow conductors thus formed can be virtually ruled out.

With the windings designed as electrical hollow conductors, due to the rectangular profile, the radial distance between the current conductor and the metallic material is kept consistently small, while with a round hollow conductor this distance is changed periodically. The uniformity of this distance resulting with the rectangular profile is advantageous since, as already mentioned above, in the part of an induction coil consisting of a hollow conductor the induction current density is at a maximum in the zone of the inside of the coil. Consequently, with a rectangular profile, the induction current runs, viewed over the length of the hollow conductor coil, nearer to the metallic material, thus resulting in reduced losses.

Some embodiments of the induction coil according to the invention are described below with reference to drawings, in which FIG. 1 shows a diagrammatic illustration of an induction furnace with an induction coil designed according to the invention in an axial section, FIG. 2 shows a diagrammatic illustration of the cross section of a length of hollow tubing in one of the axial end zones of the coil with a braid as the current-carrying element, FIG. 3 shows an illustration according to FIG. 2 with a cooling channel provided in the braid and FIG. 4 shows a diagrammatic illustration of the current connection of a braid for coupling with an electrical hollow conductor.

FIG. 1 diagrammatically shows an induction furnace with a crucible 1 for holding a metallic material (not illustrated here) and with an induction coil 2 whose magnetic field generates eddy currents in the metallic material, which heat said material.

The windings of the induction coil 2 are formed from lengths of hollow tubing 3, 4 of rectangular profile. In the central zone of the induction coil 2, the lengths of hollow tubing are hollow conductors 3 which carry the current and are made of copper. In contrast, in the upper and lower end zones of the induction coil 2, the lengths of hollow tubing 4 consist of V2A special steel, and the induction current is conducted inside these lengths of hollow tubing 4 through braids 6 made of copper. At the transition between the hollow conductor 3 and the length of hollow tubing 4 means for the electrical connection 7 of the braid 6 to the hollow conductor 3 are illustrated only diagrammatically.

Attached above and below the induction coil 2 are cooling rings 5 to increase the heat dissipation. The cooling rings 5 do not carry induction current, but only conduct a fluid coolant.

FIG. 2 shows on an enlarged scale the cross section of a length of hollow tubing 4 with a braid 6 running inside it. Consisting of V2A special steel, the length of hollow tubing 4 has a low electrical conductivity compared to copper, for which reason no significant eddy currents are induced in its walls by alternating magnetic fields. The braid 6 consists of a large number of individual conductors which are insulated from one another so that, in this case too, no extensive eddy currents can be induced. The braid 6 is surrounded by a flexible tube 8 which holds the braid 6 together and protects it from mechanical loading and additionally from possible effects of the fluid coolant.

In order to improve the dissipation of the heat generated by the current, in the embodiment according to FIG. 3, a cooling channel 9 is provided inside the braid 6.

FIG. 4 illustrates how the electrical connection of the braid 6 to the hollow conductor 3 can be constructed. For this purpose, a connection stub 10 is provided on the length of hollow tubing 4, over which stub a flexible tube 11 of glass fabric is fitted. Inserted into the other end of the flexible tube 11 is an electrically conducting stopper 12, e.g. made of copper, which seals off the flexible tube 11 and is electrically connected to the braid 6 at one of its ends and has a current terminal 13 at its other end outside the flexible tube 11. The hollow conductor 3 which is not illustrated in this figure can be electrically connected to said terminal.

Additionally, the stopper 12 has a coolant channel 14 which can allow the coolant to emerge or be passed on.

It is feasible to use a liquid or gaseous coolant to cool the induction coil.

List of reference numerals

1 Crucible
2 Induction coil
3 Hollow conductor
4 Hollow tubing
5 Cooling winding
6 Braid
7 Means for the electrical connection of the braid
8 Flexible insulating tube
9 Cooling channel
10 Connection stub
11 Flexible tube of glass fabric
12 Stopper
13 Current terminal
14 Coolant channel of the stopper

I claim:

1. A low-loss induction coil structure for heating an induction furnace, said coil structure including windings comprising:

a length of hollow electrical conductor having an internal conduit extending therethrough arranged for carrying a fluid coolant;

a current-carrying element formed from a plurality of braided, insulated, individual conductors, said element and said length of hollow electrical conductor being electrically interconnected for conducting an induction current; and a length of hollow tubing having an internal passageway extending therethrough arranged for carrying a fluid coolant, said current-carrying element being located within said passageway of the hollow tubing and not within said conduit of the hollow electrical conductor.

2. An induction coil structure as set forth in claim 1, wherein said hollow tubing is formed from a non-magnetic material having low conductivity.

3. An induction coil structure as set forth in claim 2, wherein said hollow electrical conductor and said individual conductors are made of copper.

4. An induction coil structure as set forth in claim 1, wherein said hollow tubing is formed from V2A special steel.

5. An induction coil structure as set forth in claim 4, wherein said hollow electrical conductor and said individual conductors are made of copper.

6. An induction coil structure as set forth in claim 5, wherein said hollow tubing has a rectangular cross-sectional configuration.

7. An induction coil structure as set forth in claim 5, wherein said hollow electrical conductor has a rectangular cross-sectional configuration.

8. An induction coil structure as set forth in claim 7, wherein said hollow tubing has a rectangular cross-sectional configuration.

9. An induction coil structure as set forth in claim 1, wherein said hollow electrical conductor and said individual conductors are made of copper.

10. An induction coil structure as set forth in claim 9, wherein said hollow tubing has a rectangular cross-sectional configuration.

11. An induction coil structure as set forth in claim 9, wherein said hollow electrical conductor has a rectangular cross-sectional configuration.

12. An induction coil structure as set forth in claim 11, wherein said hollow tubing has a rectangular cross-sectional configuration.

13. An induction coil structure as set forth in claim 1, wherein said individual conductors are surrounded by an insulation which is resistant to high temperatures and to the coolant.

14. An induction coil structure as set forth in claim 1, wherein a cooling channel arranged for carrying a coolant is provided inside said current-carrying element.

15. An induction coil structure as set forth in claim 1, wherein said current-carrying element is formed as a braided bundle of braids of insulated, individual conductors and said bundle is surrounded by an insulation which is resistant to high temperatures and to the coolant.

16. An induction coil structure as set forth in claim 15, wherein a cooling channel arranged for carrying a coolant is provided inside said braided bundle.

17. An induction coil structure as set forth in claim 1, wherein said hollow tubing has a rectangular cross-sectional configuration.

18. An induction coil structure as set forth in claim 1, wherein said hollow electrical conductor has a rectangular cross-sectional configuration.

19. An induction coil structure as set forth in claim 18, wherein said hollow tubing has a rectangular cross-sectional configuration.

20. An induction coil structure as set forth in claim 1, wherein is included a current terminal that is electrically connected to said current-carrying element, said terminal being attached externally to the hollow tubing.

* * * * *